US009954280B1

(12) United States Patent
Judd

(10) Patent No.: US 9,954,280 B1
(45) Date of Patent: Apr. 24, 2018

(54) DIPOLE ANTENNA WITH PARASITIC ELEMENTS

(71) Applicant: Mano D. Judd, Heath, TX (US)

(72) Inventor: Mano D. Judd, Heath, TX (US)

(73) Assignee: Mano D. Judd, Rockwall, TX (US)

( * ) Notice: Subject to any disclaimer, the term of this patent is extended or adjusted under 35 U.S.C. 154(b) by 0 days.

(21) Appl. No.: 14/471,084

(22) Filed: Aug. 28, 2014

Related U.S. Application Data

(60) Provisional application No. 61/880,034, filed on Sep. 19, 2013.

(51) Int. Cl.
*H01Q 5/00* (2015.01)
*H01Q 9/16* (2006.01)

(52) U.S. Cl.
CPC ..... *H01Q 5/0065* (2013.01); *H01Q 9/16* (2013.01)

(58) Field of Classification Search
CPC ..... H01Q 9/16; H01Q 5/0065; H01Q 9/065; H01Q 9/285
USPC ..... 343/818
See application file for complete search history.

(56) References Cited

U.S. PATENT DOCUMENTS

| | | | | |
|---|---|---|---|---|
| 6,052,098 | A * | 4/2000 | Killen et al. | 343/795 |
| 2002/0075187 | A1* | 6/2002 | McKivergan | 343/702 |
| 2002/0163476 | A1* | 11/2002 | Eriksson | 343/815 |
| 2005/0116873 | A1* | 6/2005 | Soler Castany | H01Q 1/38 343/795 |
| 2006/0055612 | A1* | 3/2006 | Kim | H01Q 13/106 343/767 |
| 2007/0229367 | A1* | 10/2007 | Fukui | H01Q 1/3208 343/700 MS |
| 2009/0066601 | A1* | 3/2009 | Eom | H01Q 1/2291 343/798 |
| 2010/0302118 | A1* | 12/2010 | Suleiman et al. | 343/808 |
| 2011/0205132 | A1* | 8/2011 | Kudo | H01Q 1/1271 343/713 |
| 2012/0293387 | A1* | 11/2012 | Ohno | 343/818 |
| 2013/0222199 | A1* | 8/2013 | Apostolos | H01Q 9/28 343/795 |

* cited by examiner

*Primary Examiner* — Daniel J Munoz

(57) ABSTRACT

An antenna comprising a plurality of legs, a plurality of parasitic elements, each disposed between two of the plurality of legs and a gap between each of the parasitic elements and each of the associated legs that the parasitic element is disposed between.

16 Claims, 8 Drawing Sheets

ANTENNA LEGS CAN BE OF ANY SUITABLE SHAPE OR SIZE

PARASITIC ELEMENTS CAN BE OF VARIOUS SUITABLE SHAPES OR SIZES

GAP DISTANCES DETERMINED BY COMPUTATION OR MEASUREMENT

200

DIPOLE ANTENNA WITH PARASITIC ELEMENTS

RELATED APPLICATIONS

This application claims the benefit of PPA Ser. No. 61/880,034—Filed: 19 Sept. 2013 by the present inventors, which is incorporated by reference.

TECHNICAL FIELD

The present disclosure relates generally to antennas, and more specifically to a dipole antenna with parasitic elements that provides improved frequency characteristics.

BACKGROUND OF THE INVENTION

Dipole antennas are typically used for applications where the frequency characteristics do not require a wide range, because dipole antennas have limited frequency bandwidth.

SUMMARY OF THE INVENTION

An antenna is disclosed that includes a plurality of legs, a plurality of parasitic elements, each disposed between two of the plurality of legs and a gap between each of the parasitic elements and each of the associated legs that the parasitic element is disposed between.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
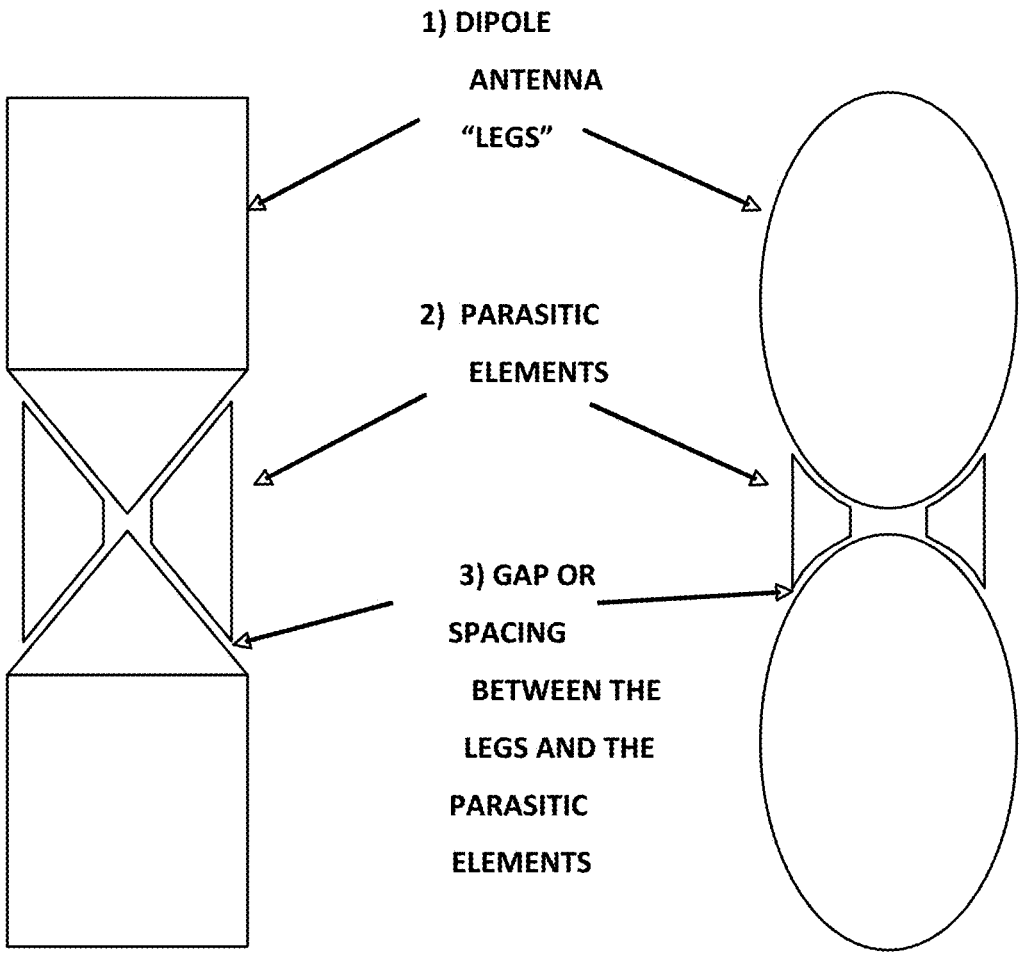
FIG. 1 is a diagram showing an antenna configuration in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as keyboards or mouses, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

An antenna typically requires a matching network to match the antenna's input (feed) impedance to 50 ohms, such as a 50 ohm transmission line. Most wideband or ultra wideband antennas have input (feed) impedance values ranging from 100 to 200 MHz. Matching the impedance to a 50 or 75 ohm transmission line requires either a complex lumped element matching network, or a bulky and lossy ferrite core transformer, both of which are usually very band limited and fairly lossy.

A conventional dipole antenna usually has a very limited bandwidth. Such dipole antennas are typically unable to achieve a 3:1 bandwidth ratio for operation above 0 dBi gain (radiation) broadside to the dipole. Moreover, the feed point impedance for most wideband dipoles is between 100 to 180 ohms. Thus, to match to a 50 ohm transmission line requires a very wideband matching network. Most of the available matching network solutions have either very limited bandwidth (on the order of a 3:1 ratio bandwidth or less) or are very lossy. This loss subtracts from the dipole gain, and further diminishes/reduces the operational bandwidth for a >0 dBi gain.

To summarize, a wideband dipole antenna with a ratio bandwidth of greater than 3:1 is needed. The dipole antenna should be capable of being implemented as a fully planar, single layer system, such as of copper or other suitable conductive materials. The dipole antenna should also be configured to be used without the need of a lumped element matching network, with a reduction of system (ohmic) losses, should be able to handle higher transmit power levels, should be of reduced complexity, size, weight and cost, and should be able to utilize a simple single 50 ohm connector. In addition, the antenna should be capable of being implemented in a conformal antenna system.

In accordance with an exemplary embodiment of the present disclosure, an antenna is provided that can be comprised of an elliptical planar dipole (or circular dipole, when A=B), an internal elliptical (A≠B) or circular (A=B) slot, to lower the frequency of the antenna system. A planar set of parasitic elements is provided between each antenna leg. The outside radius of the parasitic element (r1) and the inside radius (r2) or length, are adjusted to tune the low end and the high end of the frequency bands. This exemplary embodiment allows the use of a single 50 ohm SMA connector, directly to the feed, such that no active or lumped element matching network or balun is required. The antenna can be etched or direct written on a curved surface, can be completely planar, or can be implemented in other suitable manners.

The present disclosure utilizes an inside parasitic, which is single layer, that both tunes the antenna as well as transforms the feed impedance from the 100 to 200 ohm range, to nearly a perfect 50 ohms across a very wide bandwidth. Because a conventional wideband dipole has a natural feed impedance between 100 to 200 ohms, in order to transform it to a 50 ohm feed impedance, either a wideband lumped element matching network is employed, or usually a long slowly transitioning transmission line are used. For wideband applications, the transmission line would be quite long, usually as long or longer than the length of the dipole. For a wideband matching network, this is complex and usually incurs substantial ohmic losses, which highly reduces the efficiency of the antenna. This planar parasitic results in a feed point return loss of better than −10 dB over a very large bandwidth, on the order of a 5:1 bandwidth, and up to a 12:1 bandwidth. The present solution results in a highly efficient antenna, since the addition of the planar parasitic element does not incur any additional ohmic losses to the system. Therefore, better matching is obtained without reduction in radiation efficiency. The present solution is also symmetric and therefore does not perturb the radiation characteristics of the antenna, over the existing planar dipole radiation characteristics.

The presently disclosed parasitic solution requires only a modest increase in the amount of copper that is required, as a single layer, to be placed between the two dipole legs, in order to provide a dipole antenna with wider bandwidth. With the current gap spacing and parasitic dimensions, this planar, single layer solution generates a very good match to either a 50 ohm or 75 ohm transmission line, over a very wide bandwidth that can exceed an 8:1 ratio bandwidth. The present disclosure is extremely cost effective, and does not add any significant (ohmic) losses to the antenna.

The present disclosure can be implemented using wideband dipole antennas, such as by using antenna "leg" structures that enable wideband antenna performance. The overall shape of the antenna leg can be of various shapes, as shown in FIGS. 1-3, 5 and 6. Typically, these structures are wide, such that the width of the antenna leg is usually at least one half the length of a leg, or greater. Note, for a traditional narrowband dipole, the length, L, of a leg is usually much greater than the width, W, of the leg. For a narrowband dipole, usually W<0.1 L. However, in widening the leg, the feed point impedance of the antenna is usually increased, to well beyond 100 ohms. Ideally, the feed point impedance should be equivalent to the transmission line impedance, which is usually 50 ohms for many applications. Thus, in widening the antenna, to achieve higher bandwidth, the feed point impedance is driven higher, which generates a poor match to the transmission line.

There are various remedies to this problem, including lumped element or transmission line matched circuits. These are usually either large, expensive, or inherently narrower bandwidth themselves, than the antenna. Thus, a better solution is disclosed.

The presently disclosed parasitic element is a novel solution to this problem. The overall shape of the parasitic element can vary, but the critical element is the coupling "gap" or distance from the parasitic element to the antenna legs. This coupling gap is usually very small, and can be determined using modeling/simulation, by measurement or in other suitable manners. Adjusting the size of the parasitic element tunes the antenna, across frequency, to a better match. Also, adjusting the gap can tune the antenna to one area of the band, for better matching.

In one exemplary embodiment, the antenna can be incorporated into a larger array that can be used as part of a signals intelligence system on an unmanned aerial vehicle (UAV).

FIG. 1 is a diagram showing an antenna 100 configuration in accordance with an exemplary embodiment of the present disclosure. As shown in FIG. 1, a dipole antenna of the present disclosure can have two dipole legs that are elliptical, rectangular or other suitable configurations. Two parasitic elements are provided between the legs, with an associated gap or spacing between each parasitic element and the adjacent dipole legs. The shapes and dimensions shown in FIG. 1 are exemplary, and other suitable shapes and dimensions can also or alternatively be used.

Figure 2:
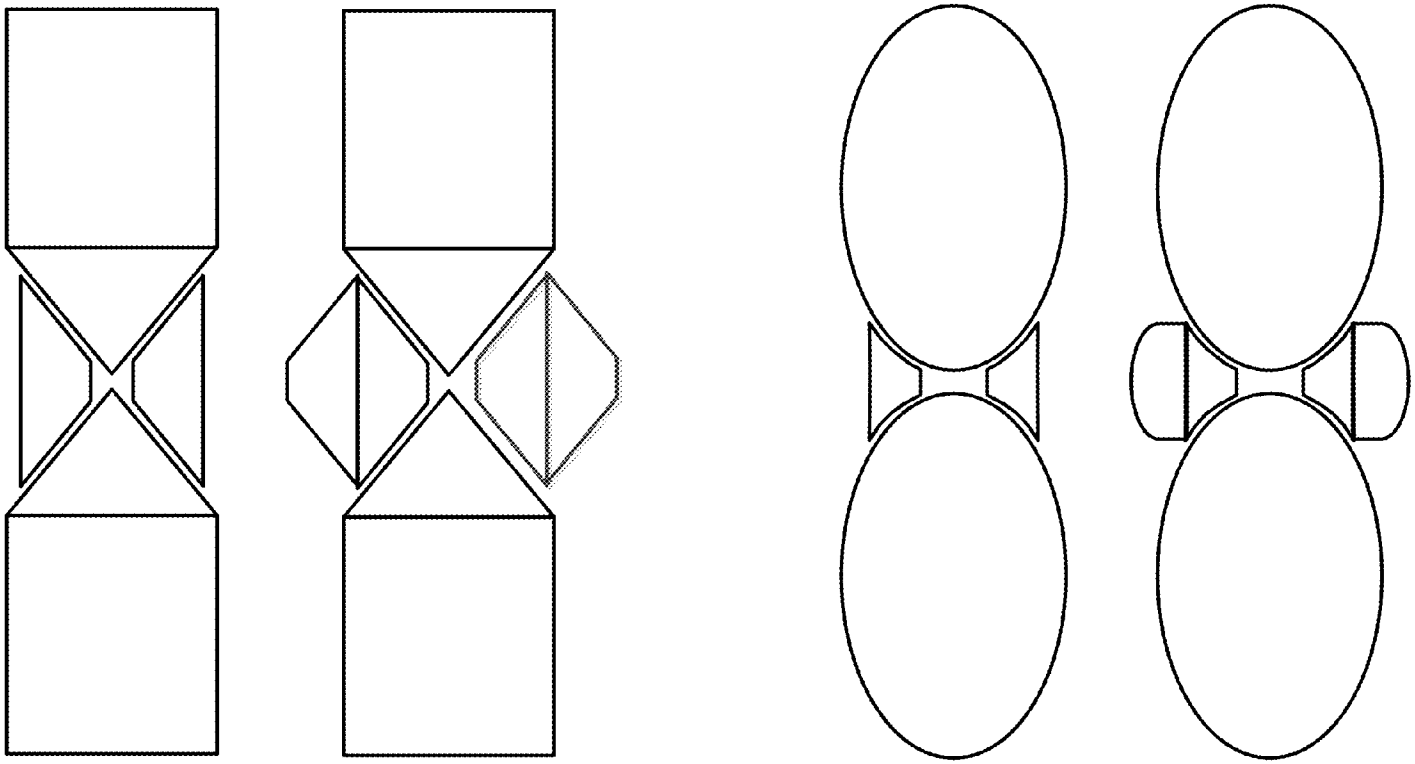
FIG. 2 is a diagram showing antenna configurations in accordance with exemplary embodiments of the present disclosure.

FIG. 2 is a diagram showing antenna 200 configurations in accordance with exemplary embodiments of the present disclosure. As shown in FIG. 2, a dipole antenna of the present disclosure can have two dipole legs that are elliptical, rectangular or other suitable configurations. Two parasitic elements are provided between the legs, with an associated gap or spacing between each parasitic element and the adjacent dipole legs. The shapes and dimensions shown in FIG. 2 are exemplary, and other suitable shapes and dimensions can also or alternatively be used.

Figure 3:
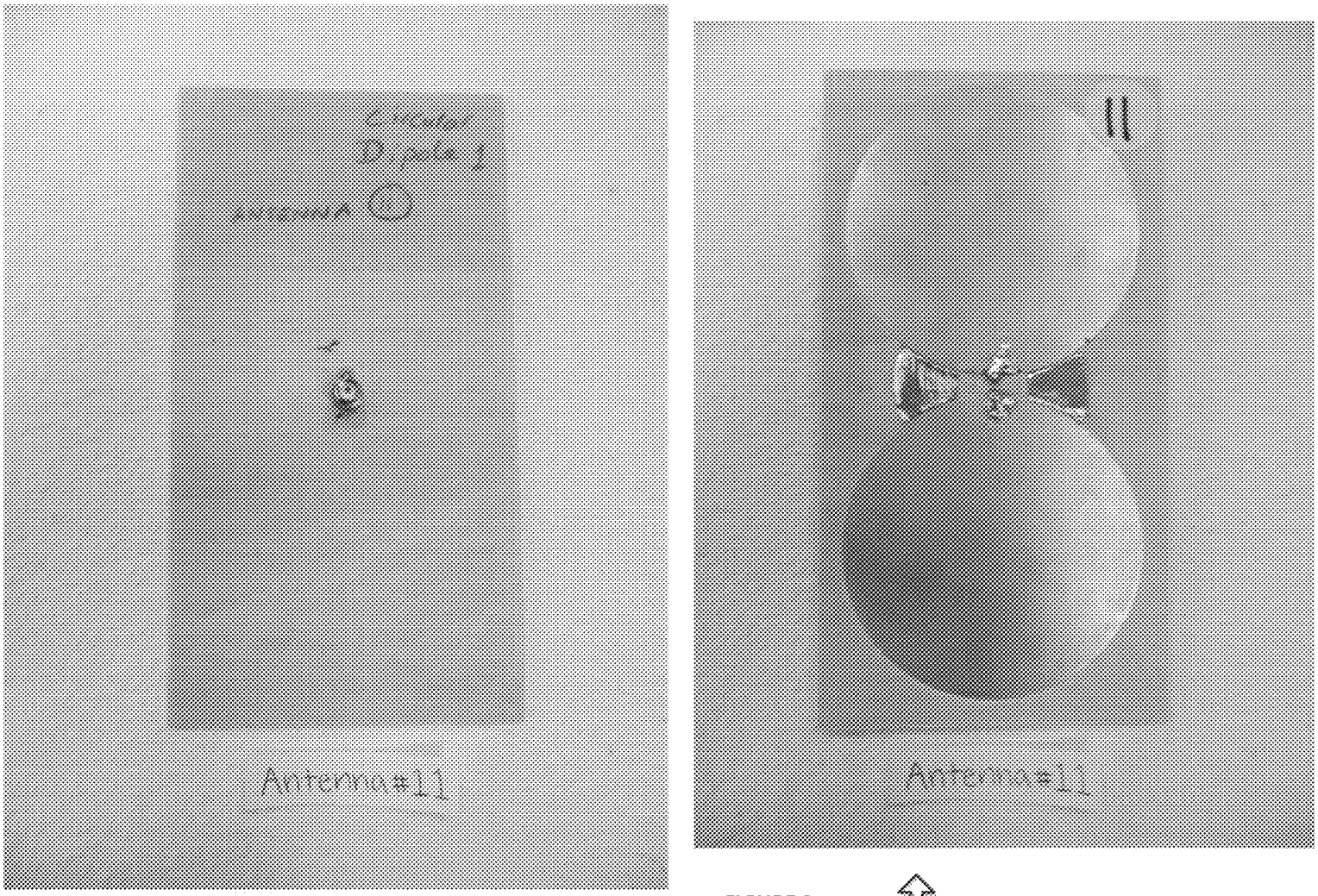
FIG. 3 is a diagram showing an antenna configuration in accordance with an exemplary embodiment of the present disclosure.

FIG. 3 is a diagram showing an antenna 300 configuration in accordance with an exemplary embodiment of the present disclosure. As shown in FIG. 3, two copper discs are disposed on one side of an insulating sheet, and parasitic elements are placed between them. A coaxial connector is disposed on the opposed side of the insulating sheet.

Figure 4:
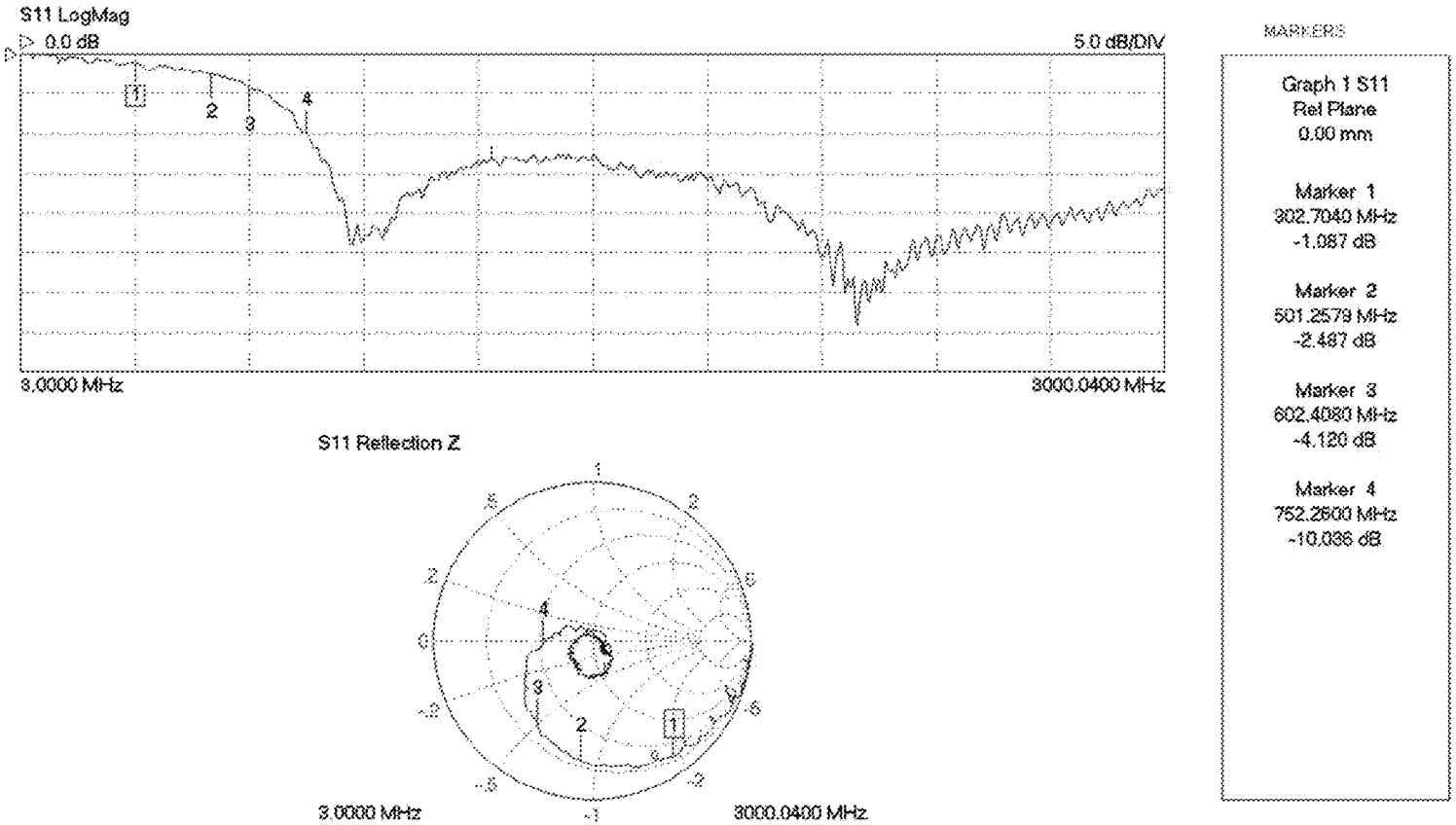
FIG. 4 is a diagram showing test results in accordance with an exemplary embodiment of the present disclosure.

FIG. 4 is a diagram showing test results 400 in accordance with an exemplary embodiment of the present disclosure. As shown in FIG. 4, the frequency response of the dipole antenna of FIG. 3 provides a Return Loss (RL) of better than −10 dB for the band ranging from 752 to 900 MHz , with an additional band from 900 MHz to over 3 GHz where the RL was better than −15 dB. The antenna was later tested in an anechoic chamber for radiation patterns and absolute gain. The results showed a 5:1 Ratio Bandwidth for gain values above +0 dBi.

Figure 5:
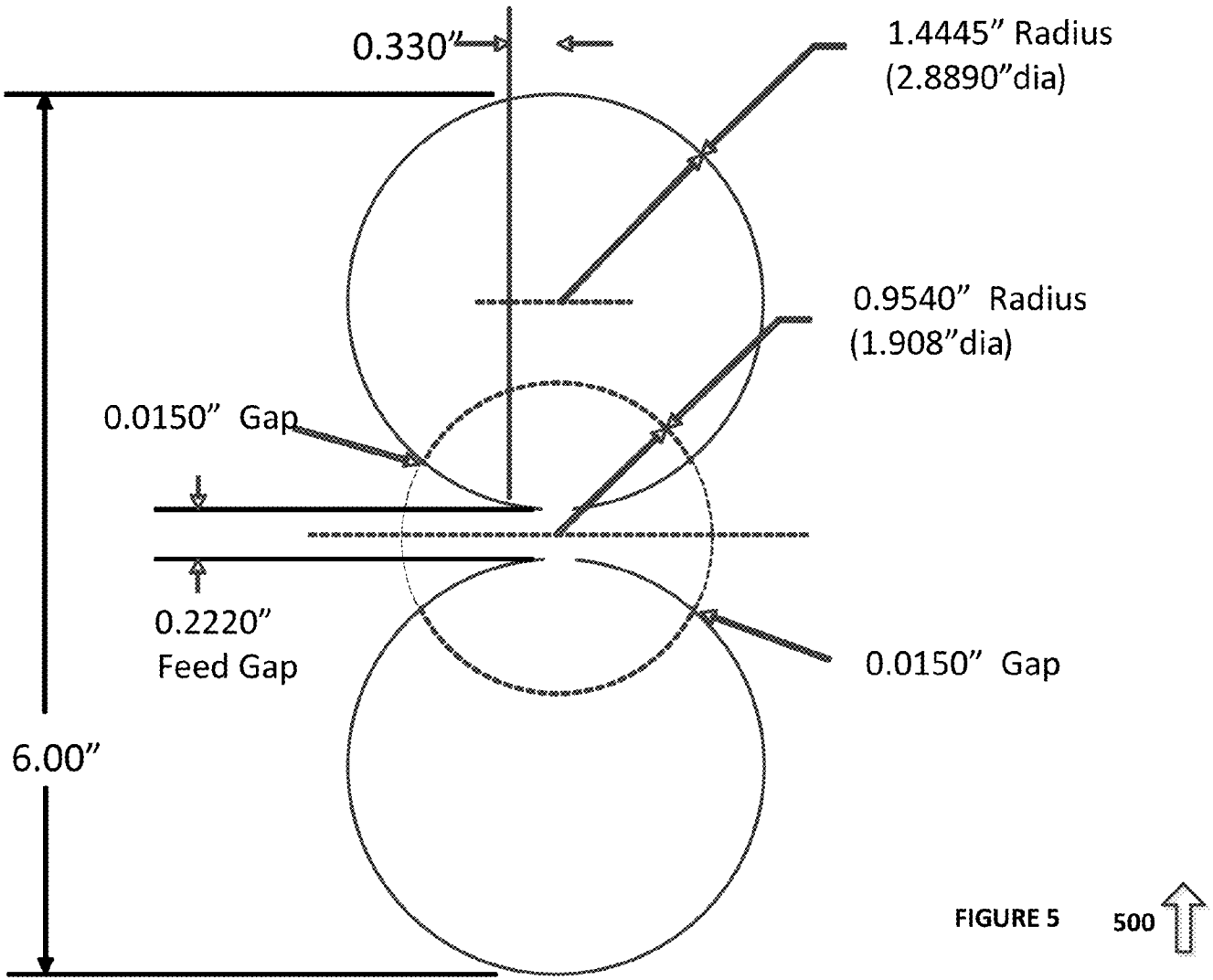
FIG. 5 is a diagram showing an antenna configuration with dimensions in accordance with an exemplary embodiment of the present disclosure.

FIG. 5 is a diagram showing an antenna 500 configuration with dimensions in accordance with an exemplary embodiment of the present disclosure. The dimensions and configuration shown are exemplary, and one of ordinary skill in the art will realize that other suitable dimensions and configurations can also or alternatively be used.

Figure 6:
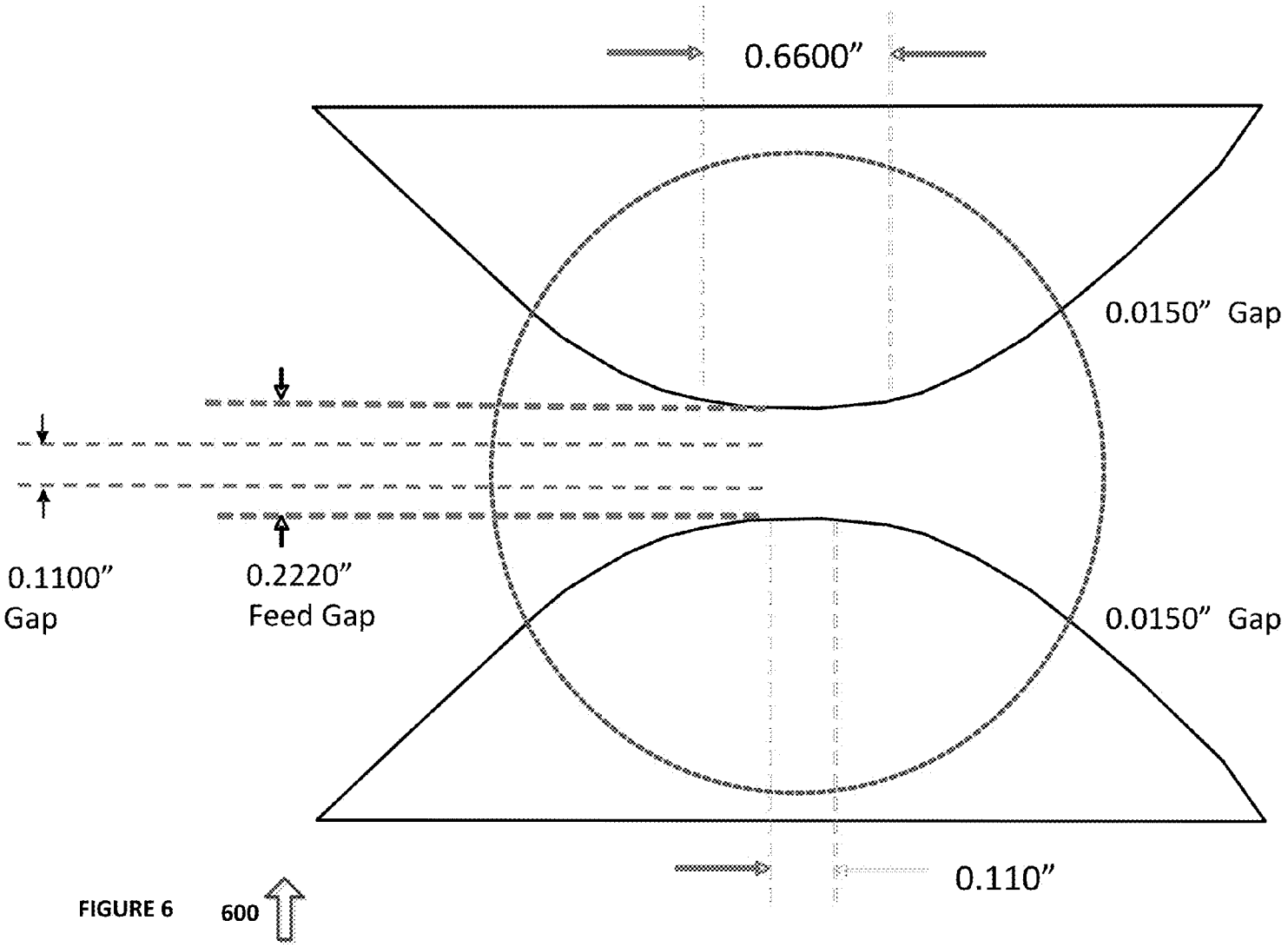
FIG. 6 is a diagram showing an antenna configuration with dimensions in accordance with an exemplary embodiment of the present disclosure.

FIG. 6 is a diagram showing an antenna 600 configuration with dimensions in accordance with an exemplary embodiment of the present disclosure. The dimensions and configuration shown are exemplary, and one of ordinary skill in the art will realize that other suitable dimensions and configurations can also or alternatively be used.

Figure 7:
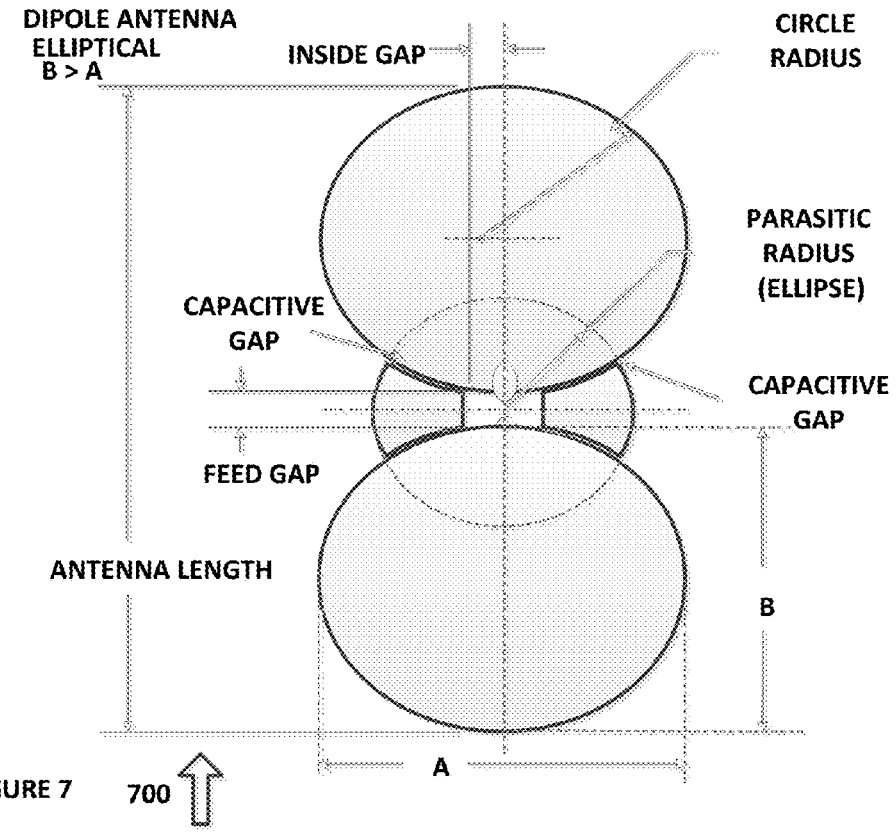
FIG. 7 is a diagram showing antenna configurations in accordance with an exemplary embodiment of the present disclosure.

FIG. 7 is a diagram showing antenna 700 configurations in accordance with an exemplary embodiment of the present disclosure. Antenna 700 is an elliptical dipole antenna with parasitic elements and a capacitive gap, feed gap and inside gap as shown.

Figure 8:
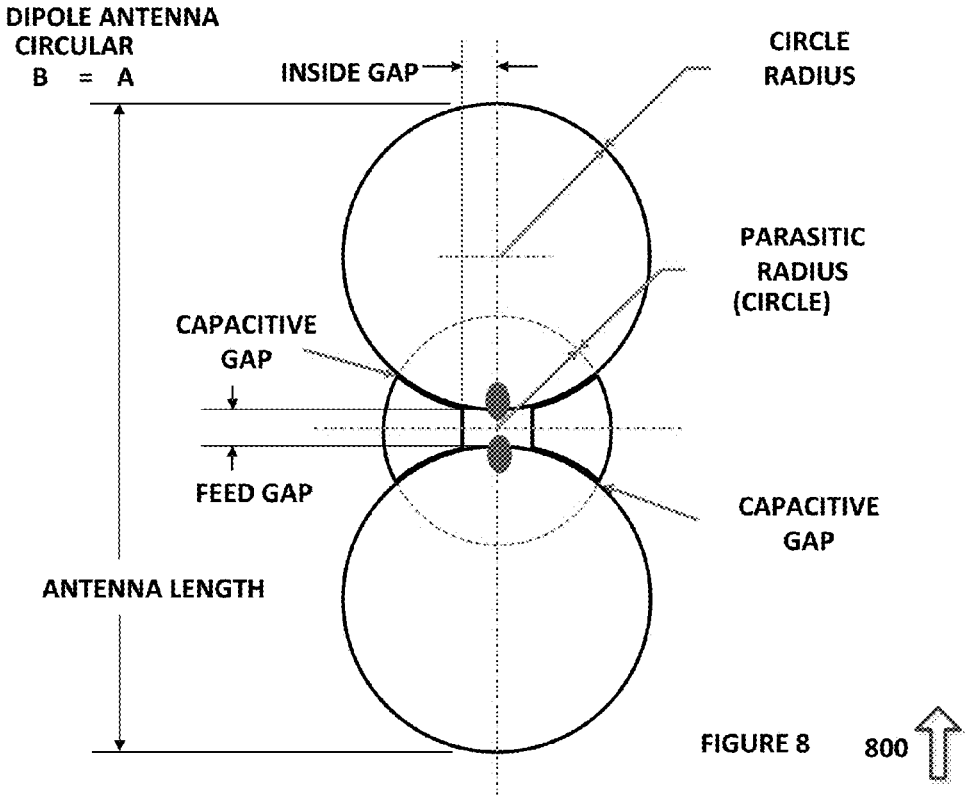
FIG. 8 is a diagram showing antenna configurations in accordance with an exemplary embodiment of the present disclosure.

FIG. 8 is a diagram showing antenna 800 configurations in accordance with an exemplary embodiment of the present disclosure. Antenna 800 is a circular dipole antenna with parasitic elements and a capacitive gap, feed gap and inside gap as shown.

Figure 9:
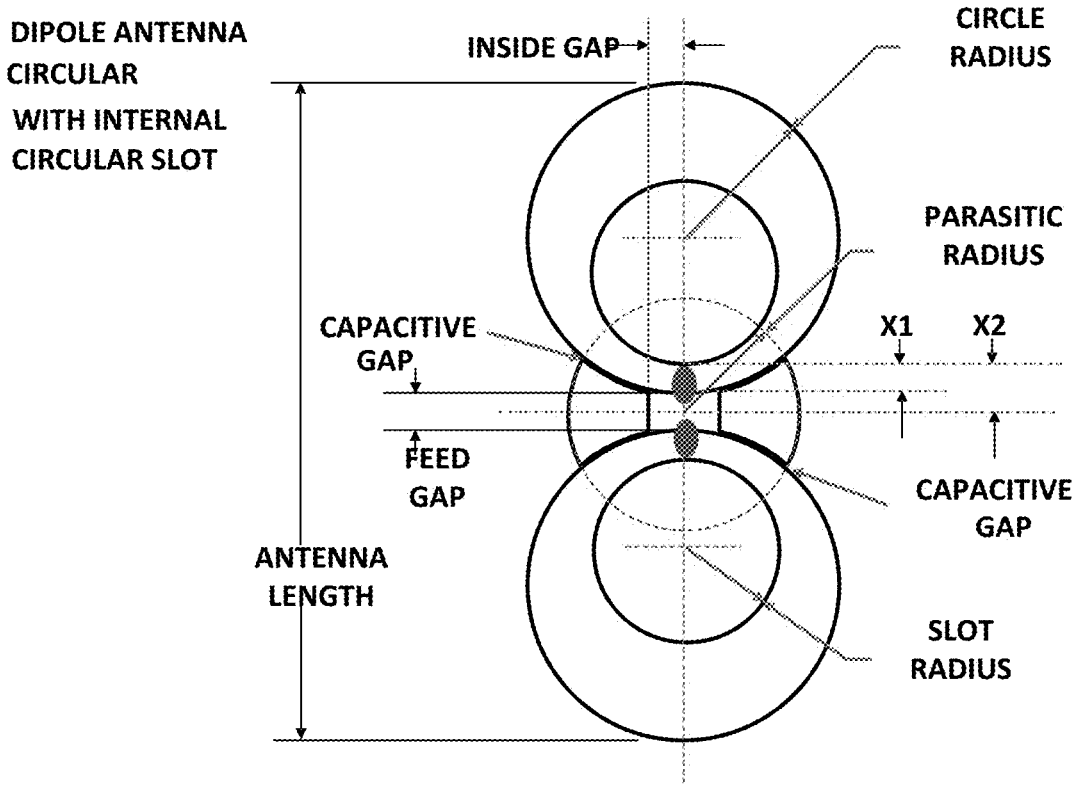
FIG. 9 is a diagram showing antenna configurations in accordance with an exemplary embodiment of the present disclosure.

FIG. 9 is a diagram showing antenna 900 configurations in accordance with an exemplary embodiment of the present disclosure. Antenna 900 is a circular dipole antenna with an internal circular slot, parasitic elements and a capacitive gap, feed gap and inside gap as shown.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A dipole antenna comprising:

two symmetric, conductive legs, with a central feed gap which is located between the two legs;

one or two conductive symmetrical parasitic elements, wherein the parasitic element(s) are each disposed between the two legs but do not overlap the two legs or touch one another.

the parasitic element(s), disposed between the two legs, wherein the greatest width of the parasitic element, or combined greatest width of the parasitic elements (if more than one) does not meet or exceed the greatest width of the two legs; and a capacitive parasitic gap between the parasitic element(s) and each of the associated legs that the parasitic element is disposed between.

2. The dipole antenna of claim 1 wherein the capacitive parasitic gap is between $3.81\times10^{-6}$ and $3.81\times10^{-3}$ times an operating frequency wavelength.

3. The dipole antenna of claim 2 wherein the dipole antenna has a feed point return loss of −10 dB or better from a ratio bandwidth of 5:1 to 12:1.

4. The dipole antenna of claim 1 wherein the capacitive parasitic gap is approximately 0.0025 times the antenna length.

5. The dipole antenna of claim 1 wherein the dipole antenna is conformal.

6. The dipole antenna of claim 1 wherein the dipole antenna can be plasma-interjected or adhered directly onto a surface using copper tape.

7. The dipole antenna of claim 1 wherein the width of the two legs is approximately 0.48 times the length.

8. The dipole antenna of claim 1 wherein the two symmetric, conductive legs each are separated by the central feed gap.

9. A dipole antenna comprising:

the two legs separated by a the central feed gap where each side is connected to the (positive/negative) transmission line or ports and one or two conductive parasitic elements (symmetric if two) around the central feed gap of the parasitic element(s) centered between the legs and proximate the legs along both lateral edges, wherein the distance between parasitic element(s) and a neighboring leg comprises the capacitive parasitic gap and wherein the distance between the center point and an edge of a parasitic element(s) comprises the central feed gap, and wherein the total width of the parasitic element (if singular) or the combined total width of the two parasitic elements (if there are two) is less than the width of the legs.

10. The dipole antenna of claim 9 wherein the capacitive parasitic gap measures between $3.81\times10^{-6}$ and $3.81\times10^{-3}$ times an operating frequency wavelength.

11. The dipole antenna of claim 9 wherein the capacitive parasitic gap is approximately 0.0025 times the antenna length.

12. The dipole antenna of claim 9 wherein the dipole antenna is conformal.

13. The dipole antenna of claim 9 wherein the dipole antenna can be plasma injected or adhered directly onto the surface, via copper tape.

14. The dipole antenna of claim 9 wherein the dipole antenna has the feed point return loss of −10 dB or better from a ratio bandwidth of 5:1 to 12:1.

15. The dipole antenna of claim 9 wherein the width of the two symmetric, conductive legs is approximately 0.48 times the length.

16. The dipole antenna of claim 9 wherein the proximity of the two symmetric, conductive legs to the conductive symmetrical parasitic elements(s) comprises a plurality of capacitive gaps; the capacitive parasitic gap and the central feed.

* * * * *